US010244317B2

(12) United States Patent
Celestinos et al.

(10) Patent No.: US 10,244,317 B2
(45) Date of Patent: Mar. 26, 2019

(54) BEAMFORMING ARRAY UTILIZING RING RADIATOR LOUDSPEAKERS AND DIGITAL SIGNAL PROCESSING (DSP) OPTIMIZATION OF A BEAMFORMING ARRAY

(71) Applicant: Samsung Electronics Co., Ltd., Suwon-si, Gyeonggi-do (KR)

(72) Inventors: Adrian Celestinos, North Hollywood, CA (US); Allan Devantier, Newhall, CA (US); Andri Bezzola, Pasadena, CA (US); Pascal M. Brunet, Pasadena, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/153,620

(22) Filed: May 12, 2016

(65) Prior Publication Data

US 2017/0085987 A1 Mar. 23, 2017

Related U.S. Application Data

(60) Provisional application No. 62/222,753, filed on Sep. 23, 2015, provisional application No. 62/222,137, filed on Sep. 22, 2015.

(51) Int. Cl.

| | |
|---|---|
| ***H04R 3/12*** | (2006.01) |
| *H04R 3/04* | (2006.01) |
| *H04R 1/40* | (2006.01) |

(52) U.S. Cl.

CPC ..... *H04R 3/12* (2013.01); *H04R 1/403* (2013.01); *H04R 3/04* (2013.01); *H04R 2201/40* (2013.01); *H04R 2203/12* (2013.01)

(58) Field of Classification Search

CPC ..... H04R 3/04; H04R 3/12; H04R 2201/40; H04R 2203/12; H04R 2430/01; H04R 1/403

USPC ..... 381/103, 98, 99, 150, 59, 58; 700/94

See application file for complete search history.

(56) References Cited

U.S. PATENT DOCUMENTS

| | | | | |
|---|---|---|---|---|
| 5,872,339 | A | 2/1999 | Hanson | |
| 5,940,347 | A | 8/1999 | Raida et al. | |
| 7,359,520 | B2 | 4/2008 | Brennan et al. | |
| 7,826,623 | B2 | 11/2010 | Christoph | |
| 7,912,240 | B2 | 3/2011 | Madaffari et al. | |
| 8,000,170 | B2 | 8/2011 | Kablotsky | |
| 8,111,836 | B1 * | 2/2012 | Graber | G10K 11/178 181/145 |
| 8,139,774 | B2 | 3/2012 | Berardi et al. | |

(Continued)

OTHER PUBLICATIONS

M. M. Boone and O. Ouweltjes, "Design of a loudspeaker system with a low-frequency cardiod-like radiation pattern", J. Audio Eng. Soc., vol. 45, No. 9, Sep. 1997, pp. 702-707.*

(Continued)

*Primary Examiner* — Vivian Chin
*Assistant Examiner* — Con P Tran
(74) *Attorney, Agent, or Firm* — Sherman IP LLP; Kenneth L. Sherman; Hemavathy Perumal

(57) ABSTRACT

One embodiment provides a sound apparatus comprising a plurality of driver units arranged linearly in an end-fire array, and for each driver unit, a corresponding digital filter for individual digital signal processing of signals received by the driver unit.

20 Claims, 14 Drawing Sheets

(56) References Cited

U.S. PATENT DOCUMENTS

| | | | | |
|---|---|---|---|---|
| 8,160,268 | B2 | 4/2012 | Horbach | |
| 8,189,828 | B2 | 5/2012 | Takumai | |
| 8,265,310 | B2 | 9/2012 | Berardi et al. | |
| 8,320,580 | B2 | 11/2012 | Kadar | |
| 8,428,295 | B2 | 4/2013 | Humphreys | |
| 8,472,655 | B2 | 6/2013 | Srinivasan et al. | |
| 8,553,894 | B2 | 10/2013 | Berardi et al. | |
| 8,675,899 | B2 | 3/2014 | Jung | |
| 8,787,560 | B2 | 7/2014 | Buck et al. | |
| 8,831,248 | B2 | 9/2014 | Mellow et al. | |
| 8,873,340 | B1 | 10/2014 | Cray | |
| 8,891,783 | B2 | 11/2014 | Tan et al. | |
| 9,100,734 | B2 | 8/2015 | Visser | |
| 2005/0286346 | A1 | 12/2005 | Croft et al. | |
| 2006/0093128 | A1* | 5/2006 | Oxford | H04M 9/082 379/406.01 |
| 2007/0127736 | A1 | 6/2007 | Christoph | |
| 2007/0217621 | A1 | 9/2007 | Takumai | |
| 2007/0263889 | A1 | 11/2007 | Melanson | |
| 2008/0089522 | A1 | 4/2008 | Baba et al. | |
| 2008/0240463 | A1 | 10/2008 | Florencio et al. | |
| 2009/0034763 | A1 | 2/2009 | Takumai | |
| 2009/0060236 | A1 | 3/2009 | Johnston et al. | |
| 2010/0142733 | A1* | 6/2010 | Choi | H04R 3/12 381/300 |
| 2010/0329480 | A1* | 12/2010 | Boone | H04R 1/403 381/94.1 |
| 2012/0008815 | A1* | 1/2012 | Humphreys | H04R 9/04 381/400 |
| 2012/0033834 | A1 | 2/2012 | Mellow et al. | |
| 2012/0148053 | A1 | 6/2012 | Tan et al. | |
| 2012/0321102 | A1 | 12/2012 | Lim et al. | |
| 2013/0272097 | A1 | 10/2013 | Kim et al. | |
| 2014/0098971 | A1 | 4/2014 | Kadar | |
| 2014/0185854 | A1 | 7/2014 | Murphy | |

OTHER PUBLICATIONS

International Search Report and Written Opinion dated Nov. 30, 2016 for International Application No. PCT/KR2016/010393 from the International Searching Authority, pp. 1-12, Korean Intellectual Property Office, Daejeon, Republic of Korea.

Boone, M.M. et al., "Design of a highly Directional Endfire Loudspeaker Array", J. Audio Engineering Society, May 2009, pp. 309-325, vol. 57, Issue 5, United States.

Berryman, J., "Subwoofer Arrays—A Practical Guide", Electro-Voice, Jun. 7, 2010, pp. 1-35, Version 1, Bosch Communications Systems, United States.

* cited by examiner

BEAMFORMING ARRAY UTILIZING RING RADIATOR LOUDSPEAKERS AND DIGITAL SIGNAL PROCESSING (DSP) OPTIMIZATION OF A BEAMFORMING ARRAY

CROSS-REFERENCE TO RELATED APPLICATIONS

The present application claims priority to U.S. Provisional Patent Application No. 62/222,753, filed on Sep. 23, 2015, and U.S. Provisional Patent Application No. 62/222,137, filed on Sep. 22, 2015, which are both hereby incorporated by reference in its entirety.

COPYRIGHT DISCLAIMER

A portion of the disclosure of this patent document may contain material that is subject to copyright protection. The copyright owner has no objection to the facsimile reproduction by anyone of the patent document or the patent disclosure as it appears in the patent and trademark office patent file or records, but otherwise reserves all copyright rights whatsoever.

TECHNICAL FIELD

One or more embodiments relate generally to loudspeakers, and in particular, a beamforming array utilizing ring radiator loudspeakers and digital signal processing (DSP) optimization of a beamforming array.

BACKGROUND

A loudspeaker produces sound when connected to an integrated amplifier, a television (TV) set, a radio, a music player, an electronic sound producing device (e.g., a smartphone), a video player, etc.

SUMMARY

One embodiment provides a sound apparatus comprising a plurality of driver units arranged linearly in an end-fire array, and for each driver unit, a corresponding digital filter for individual digital signal processing of signals received by the driver unit.

Another embodiment provides a method of beamforming sound for driver units in an array. The method comprises measuring, for each driver unit in the array, an angular response of the driver unit over a pre-determined frequency grid at a set of pre-determined angles, and defining, for each frequency of the frequency grid, a target angular response based on a reference angular response weighted along the set of pre-determined angles. The method further comprises estimating, for each frequency of the frequency grid, an optimum gain vector based on the target angular response and each angular response measured at the frequency at each of the set of pre-determined angles, and defining, for each driver unit in the array, a digital filter based on each optimum gain vector estimation.

One embodiment provides a method for producing a beamforming array. The method comprises determining a desired attenuation, determining an end-fire configuration layout based on the desired attenuation, and fabricating a beamforming array by arranging a plurality of driver units in accordance with the end-fire configuration layout.

These and other features, aspects and advantages of the one or more embodiments will become understood with reference to the following description, appended claims and accompanying figures.

DETAILED DESCRIPTION

Figure 1:
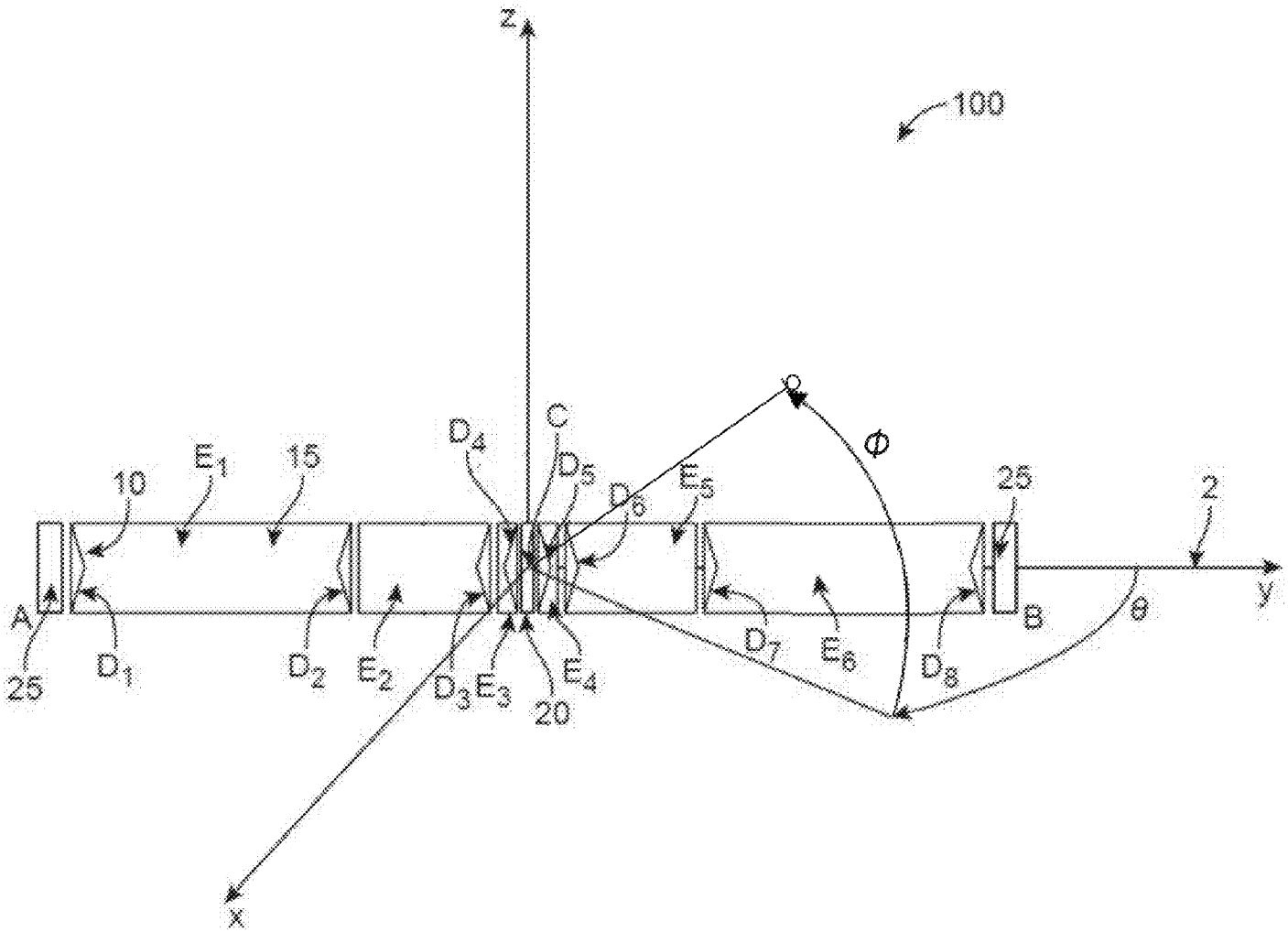
FIG. 1 illustrates an example beamforming array, in accordance with an embodiment.

The following description is made for the purpose of illustrating the general principles of one or more embodiments and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to loudspeakers, and in particular, a beamforming array utilizing ring radiator loudspeakers and digital signal processing (DSP) optimization of a beamforming array. One embodiment provides a sound apparatus comprising a plurality of driver units arranged linearly in an end-fire array, and for each driver unit, a corresponding digital filter for individual digital signal processing of signals received by the driver unit.

Another embodiment provides a method of beamforming sound for driver units in an array. The method comprises, for each driver unit in the array, measuring angular responses of the driver unit over a pre-determined frequency grid at a set of pre-determined angles. For each frequency of the frequency grid, a corresponding target angular response is defined based on a regular angular response that is weighted along the set of pre-determined angles, and a corresponding optimum gain vector is defined based on the corresponding target angular response and each angular response measured at the frequency at each of the set of pre-determined angles. The method further comprises, for each driver unit, defining a corresponding digital filter based on each optimum gain vector estimation.

One embodiment provides a method for producing a beamforming array. The method comprises determining a desired attenuation, determining an end-fire configuration layout based on the desired attenuation, and fabricating a beamforming array by arranging a plurality of driver units in accordance with the end-fire configuration layout.

Typically, a loudspeaker comprising a single regular direct radiator mounted inside its enclosure provides different sound directivity at different frequencies (i.e., low, mid and high frequencies). For example, at low frequencies, the sound distribution from the loudspeaker is omnidirectional. At mid and high frequencies, the loudspeaker may beam sound with irregular directivity as a result of one or more dimensions of the diaphragm of the loudspeaker being in close proximity to one or more of the radiated sound wavelengths.

In some applications of audio reproduction, it is desirable to obtain constant sound directivity over a range of frequencies and to produce narrow dispersion of sound along a desired direction. To obtain narrow dispersion and constant sound directivity over a range of frequencies, to aim a beam of sound in a desired direction, one embodiment of the invention provides an array of drivers arranged in an end-fire array configuration ("end-fire loudspeaker array"). Each driver and its corresponding amplification channel is provided with suitable multichannel digital signal processing (DSP).

Another embodiment of the invention provides one or more digital filters for beamforming of sound produced by an end-fire loudspeaker array. Each driver of the array has a corresponding defined optimal filter, in order to obtain a specified and highly directive angular response for the entire array over a large frequency bandwidth (i.e., a large range of frequencies or a large frequency interval).

Another embodiment provides a loudspeaker that radiates sound in different directions, where the radiation pattern of the sound radiated is based on dimensions of the loudspeaker and its cylinder.

FIG. 1 illustrates an example beamforming array 100, in accordance with an embodiment. The beamforming array 100 comprises a plurality of driver units 10 and a plurality of cylindrical containers ("cylinders") 15. Each driver unit 10 is housed in its own independent enclosure (not shown). In one embodiment, each driver unit 10 comprises a ring radiator. Each driver unit 10 (and its independent enclosure) is mounted on one of the cylinders 15.

As shown in FIG. 1, the beamforming array 100 A comprises a pair of opposing end walls A and B. A first end plug 25 and a second end plug 25 may be positioned at end wall A and end wall B, respectively. The beamforming array 100 may further comprise an optional center plug 20 positioned at a center C of the beamforming array 100.

The number of driver units 10 included in the beamforming array 100 may vary. N is a number of driver units 10 included in the beamforming array 100, wherein $N \geq 2$, and N may be either an even number or an odd number. $D_i$ is a driver unit 10 included in the beamforming array 100, wherein $1 <= i <= N$. $E_j$ is a cylinder 15 included in the beamforming array 100, wherein $j <= N$.

The driver units 10 are arranged linearly along a first axis 2 (e.g., y-axis) in an end-fire configuration. The number of driver units 10 and arrangement of the driver units 10 along the first axis 2 may be adjusted, such that various end-fire configuration layouts are possible. For example, as shown in FIG. 1, the beamforming array 100 may comprise eight (8) driver units 10, such as driver units $D_1$, $D_2$, . . . , and $D_8$.

Each cylinder 15 contains at least one of the driver units 10. In one embodiment, each driver unit 10 has its own corresponding cylinder 15 on which the driver unit 10 is mounted. In another embodiment, multiple driver units 10 may be mounted on the same cylinder 15. For example, as shown in FIG. 1, driver units $D_1$ and $D_2$ are mounted on a first cylinder $E_1$, driver unit $D_3$ is mounted on a second cylinder $E_2$, driver unit $D_4$ is mounted on a third cylinder $E_3$, driver unit $D_5$ is mounted on a fourth cylinder $E_4$, driver unit $D_6$ is mounted on a fifth cylinder $E_5$, and driver units $D_7$ and $D_8$ are mounted on a sixth cylinder $E_6$.

The driver units 10 may be physically oriented to face the same direction or different directions based on physical constraints of the driver units 10. For example, as shown in FIG. 1, if two driver units 10 are mounted on the same cylinder 15 (e.g., driver units $D_1$ and $D_2$ mounted on first cylinder $E_1$), the two driver units 10 may be physically oriented to face different directions. As another example, if each driver unit 10 has its own corresponding cylinder 15 on which the driver unit 10 is mounted, the driver units 10 may be physically oriented to face the same direction.

$(\theta, \phi)$ is a spherical coordinate system, wherein $\theta$ is an azimuth angle measured from one end of an axis of symmetry of the beamforming array 100 (e.g., y-axis), and $\phi$ is an elevation angle. Each driver unit 10 propagates sound similarly to a monopole sound source over the elevation angle $\phi$. As a result, sound directivity of the beamforming array 100 is substantially omnidirectional over the elevation angle $\phi$ and over a large sound frequency bandwidth (e.g., 10 Hz to 10 kHz).

With a beamforming array 100, only optimization of sound directivity over the azimuth angle $\theta$ is necessary, thereby simplifying the process of resolving any issues arising from beamforming of sound. As described in detail later herein, in one embodiment, sound directivity over the azimuth angle $\theta$ may be optimized utilizing digital filters.

Compared to conventional loudspeakers, the beamforming array 100 together with the digital filters allow for narrow dispersion of sound and constant sound directivity over a large sound frequency bandwidth (e.g., 10 Hz to 10 kHz). With the beamforming array 100 and the digital filters, a beam of sound may be aimed in a desired direction.

The beamforming array 100 may be utilized in sound bars, multichannel loudspeaker systems, microphones, ultrasonic applications, sonar applications, etc.

Conventional loudspeaker arrays have been discovered to allow for attenuation of 8 dB over a single decade, where θ=90 degrees. By comparison, as later shown in FIGS. 4B, 5B, 6B and 7B, a beamforming array 100 is robust with regards to a physical layout and characteristics of driver units 10 included in the array 100, enabling attenuation of 20 dB over three decades.

Figure 2:
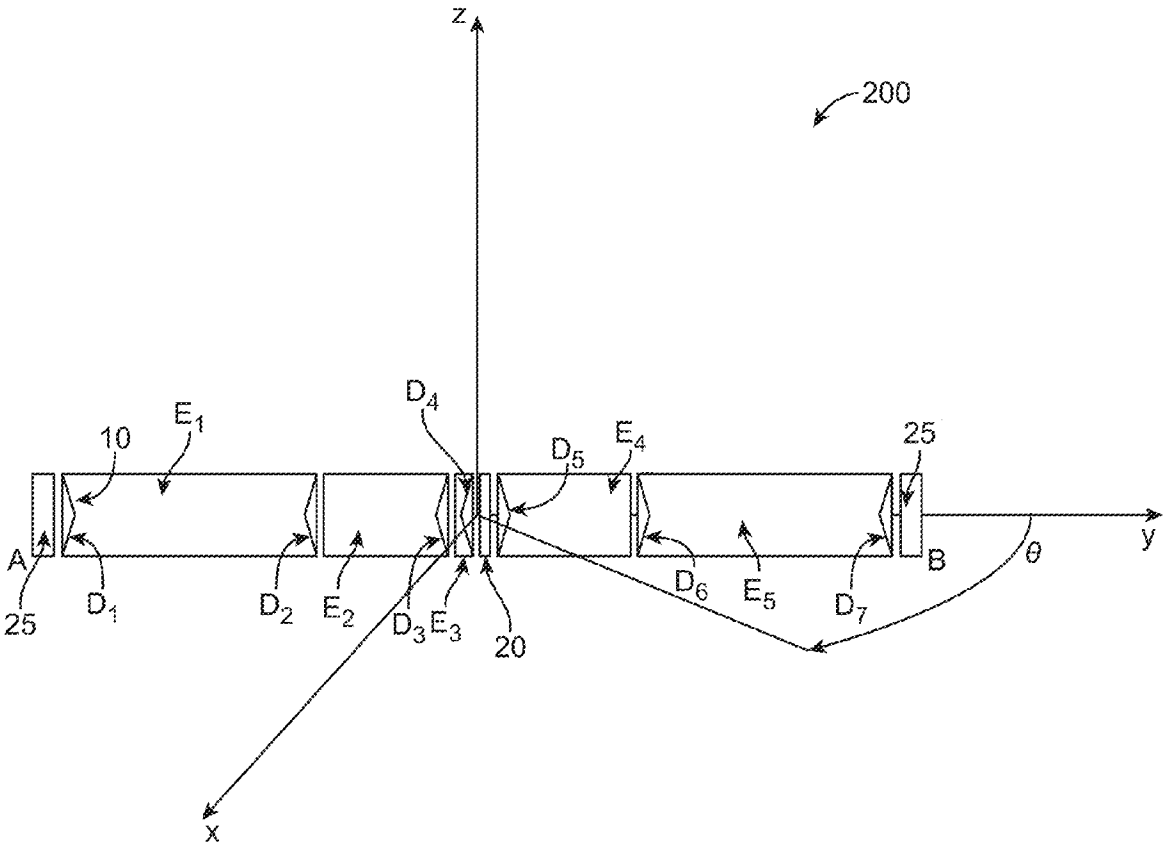
FIG. 2 illustrates another example beamforming array with a different end-fire configuration layout, in accordance with an embodiment.

FIG. 2 illustrates another example beamforming array 200 with a different end-fire configuration layout, in accordance with an embodiment. The beamforming array 200 comprises a plurality of driver units 10 and a plurality of cylinders 15. The number of driver units 10 included in the beamforming array 200 may be either an even number or an odd number. For example, as shown in FIG. 2, the beamforming array 200 may comprise seven (7) driver units 10, such as driver units $D_1$, $D_2$, . . . , and $D_7$.

Each cylinder 15 contains at least one of the driver units 10. In one embodiment, each driver unit 10 has its own corresponding cylinder 15 on which the driver unit 10 is mounted. In another embodiment, multiple driver units 10 may be mounted on the same cylinder 15. For example, as shown in FIG. 2, driver units $D_1$ and $D_2$ are mounted on a first cylinder E1, driver unit $D_3$ is mounted on a second cylinder $E_2$, driver unit $D_4$ is mounted on a third cylinder $E_3$, driver unit $D_5$ is mounted on a fourth cylinder $E_4$, and driver units $D_6$ and $D_7$ are mounted on a fifth cylinder $E_5$.

Figure 3:
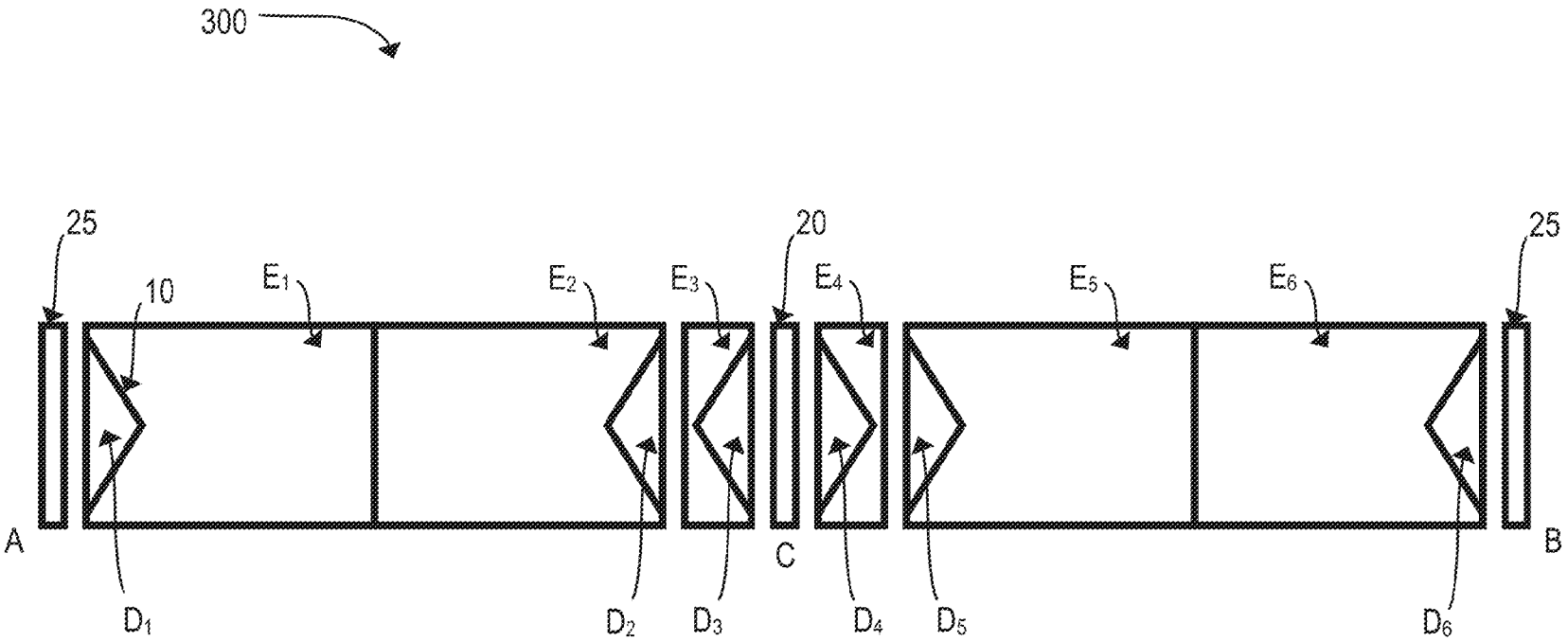
FIG. 3 illustrates another example beamforming array with a different end-fire configuration layout, in accordance with an embodiment.

FIG. 3 illustrates another example beamforming array 300 with a different end-fire configuration layout, in accordance with an embodiment. The beamforming array 300 comprises a tightly spaced cluster of driver units 10 at a center C of the beamforming array 300. The number of driver units 10 included in the beamforming array 300 may be either an even number or an odd number. For example, as shown in FIG. 3, the beamforming array 300 comprises six (6) driver units 10, such as driver units $D_1$, $D_2$, . . . , and $D_6$.

The beamforming array further comprises a plurality of cylinders 15. Each cylinder 15 contains at least one of the driver units 10. In one embodiment, each driver unit 10 has its own corresponding cylinder 15 on which the driver unit 10 is mounted. For example, as shown in FIG. 3, driver unit $D_1$ is mounted on a first cylinder $E_1$, driver unit $D_2$ is mounted on a second cylinder $E_2$, driver unit $D_3$ is mounted on a third cylinder $E_3$, driver unit $D_4$ is mounted on a fourth cylinder $E_4$, driver unit $D_5$ is mounted on a fifth cylinder $E_5$, and driver unit $D_6$ is mounted on a sixth cylinder $E_6$. In another embodiment, multiple driver units 10 may be mounted on the same cylinder 15.

All but two driver units 10 in the beamforming array 300 are spaced as closely/tightly as possible around the center C of the beamforming array 300, while the remaining two driver units 10 are positioned within proximity of opposing end walls A and B of the beamforming array 300. For example, as shown in FIG. 3, driver units $D_2$, $D_3$, $D_4$ and $D_5$ in the beamforming array 300 are arranged as a tightly spaced cluster positioned around the center C, and the two remaining driver units $D_1$ and $D_6$ are positioned within proximity of the end walls A and B, respectively. The extent to which driver units 10 may be spaced as closely/tightly together as possible is based on the smallest independent enclosure possible for the size of a driver unit 10.

Figure 4A:
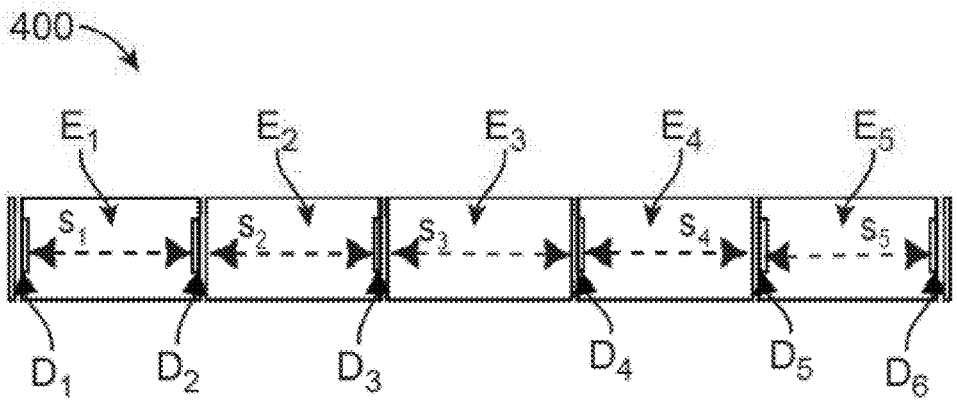
FIG. 4A illustrates another example beamforming array with a different end-fire configuration layout, in accordance with an embodiment.

FIG. 4A illustrates another example beamforming array 400 with a different end-fire configuration layout, in accordance with an embodiment. The beamforming array 400 comprises a plurality of driver units 10 that are equally spaced apart. The number of driver units 10 included in the beamforming array 400 may be either an even number or an odd number. For example, as shown in FIG. 4A, the beamforming array 400 may comprise six (6) driver units 10, such as driver units $D_1$, $D_2$, . . . , and $D_6$.

$s_1$ is a spacing between driver units $D_1$ and $D_2$, $s_2$ is a spacing between driver units $D_2$ and $D_3$, $s_3$ is a spacing between driver units $D_3$ and $D_4$, $s_4$ is a spacing between driver units $D_4$ and $D_5$, and $s_5$ is a spacing between driver units $D_5$ and $D_6$. There is equal spacing between the drivers units 10 (i.e., $s_1=s_2=s_3=s_4=s_5$).

Figure 4B:
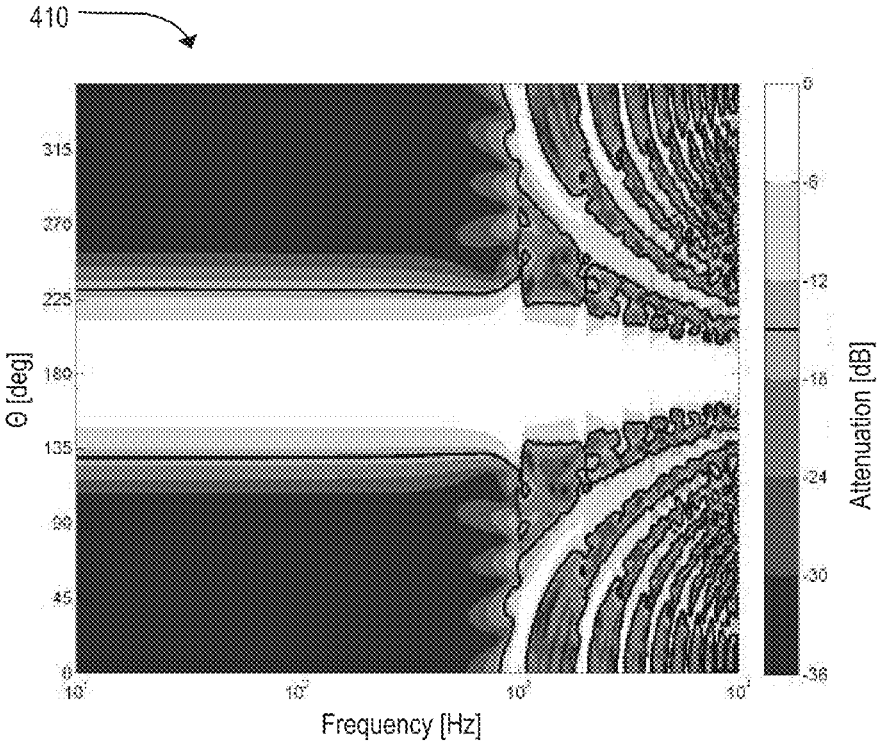
FIG. 4B is an example graph illustrating sound directivity curves in decibels (dB) for the beamforming array in FIG. 4A, in accordance with one embodiment.

FIG. 4B is an example graph 410 illustrating sound directivity curves in decibels (dB) for the beamforming array 400 in FIG. 4A, in accordance with one embodiment. The graph 410 shows sound directivity relative to a target direction for each azimuth angle θ in the range of [0°, 360°] and for each sound frequency in the range of [10 Hz, 10 kHz]. The beamforming array 100 in FIG. 4A produces a narrow distribution/dispersion of sound around 180° with at least 20 dB of attenuation outside the range of 90° to 270° for frequencies below 8 kHz.

Figure 5A:
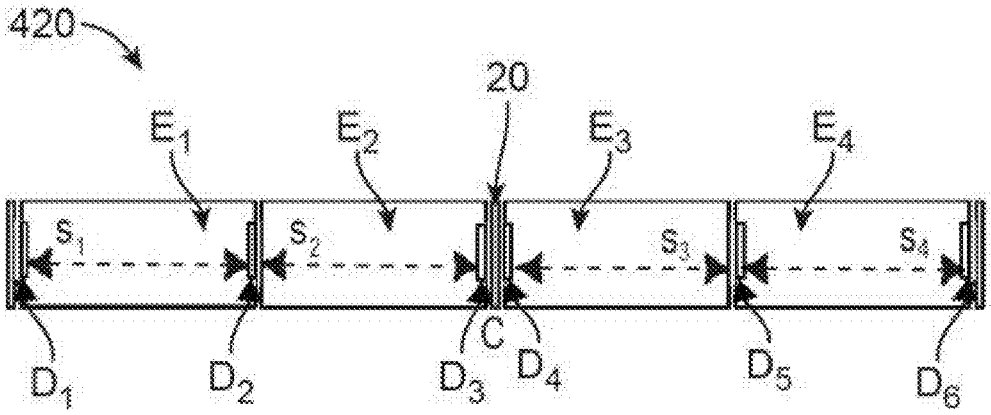
FIG. 5A illustrates another example beamforming array with a different end-fire configuration layout, in accordance with an embodiment.

FIG. 5A illustrates another example beamforming array 420 with a different end-fire configuration layout, in accordance with an embodiment. The beamforming array 420 comprises two driver units 10 positioned about a center C of the beamforming array 420, and additional driver units 10 equally spaced apart. The number of driver units 10 included in the beamforming array 420 may be either an even number or an odd number. For example, as shown in FIG. 5A, the beamforming array 100 in FIG. 5A may comprise six (6) driver units 10, such as driver units $D_1$, $D_2$, . . . , and $D_6$.

$s_1$ is a spacing between driver units $D_1$ and $D_2$, $s_2$ is a spacing between driver units $D_2$ and $D_3$, $s_3$ is a spacing between driver units $D_4$ and $D_5$, and $s_4$ is a spacing between driver units $D_5$ and $D_6$. As shown in FIG. 5A, drivers units $D_3$ and $D_4$ are positioned as close as possible to a center C, and driver units $D_1$, $D_2$, $D_5$ and $D_6$ are equally spaced (i.e., $s_1=s_2=s_3=s_4$). As the center plug 20 does not include a driver unit 10, the proximity of the two driver units $D_3$ and $D_4$ to the center C can be as close as mechanical constructions allows it to be.

Figure 5B:
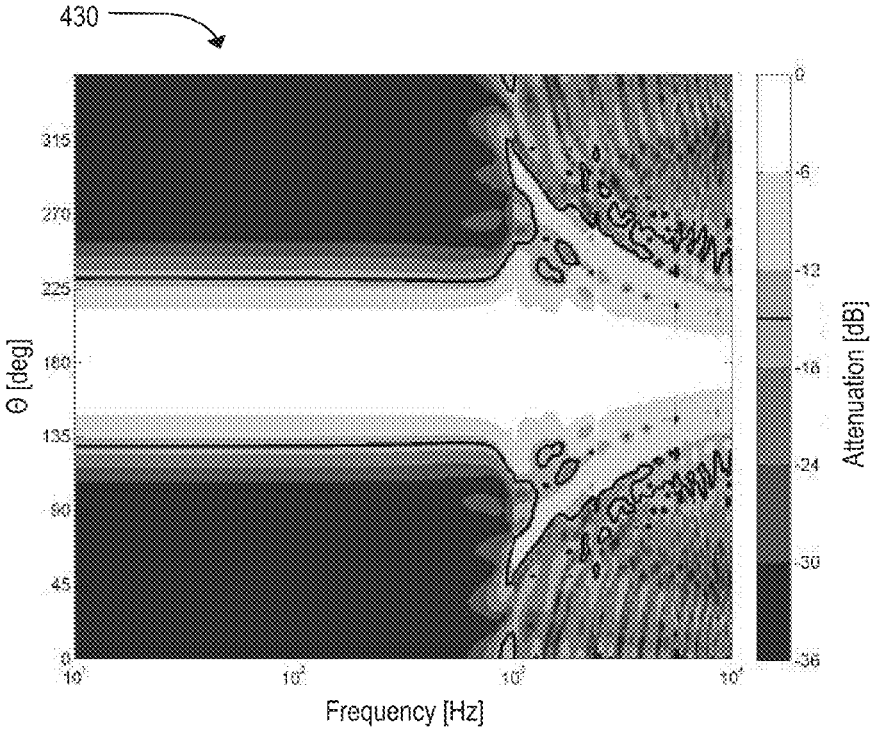
FIG. 5B is an example graph illustrating sound directivity curves in dB for the beamforming array in FIG. 5A, in accordance with one embodiment.

FIG. 5B is an example graph 430 illustrating sound directivity curves in dB for the beamforming array 420 in FIG. 5A, in accordance with one embodiment. Graph 430 further shows that sound performance decreases at high frequencies as spacing between driver units 10 increases.

Figure 6A:
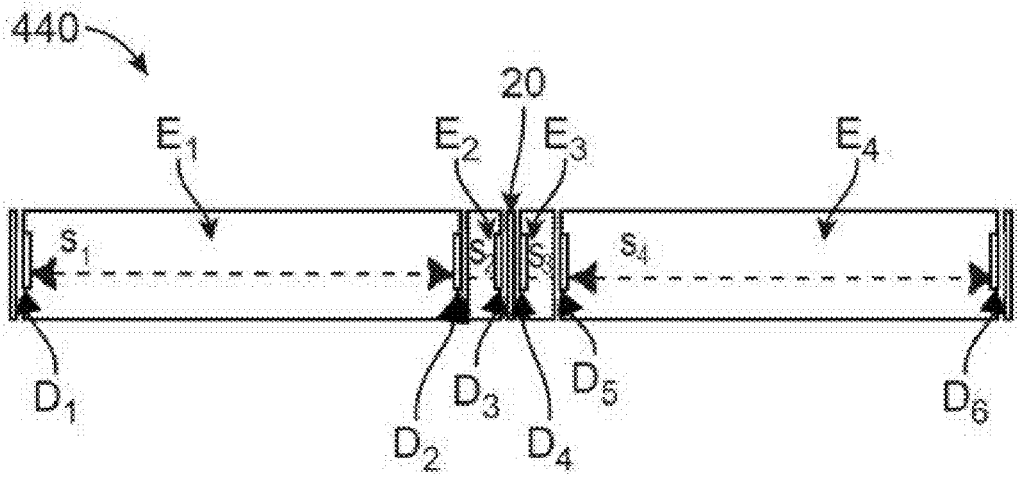
FIG. 6A illustrates another example beamforming array with a different end-fire configuration layout, in accordance with an embodiment.

FIG. 6A illustrates another example beamforming array 440 with a different end-fire configuration layout, in accordance with an embodiment. The beamforming array 440 comprises a plurality of driver units 10, wherein spacing between the driver units 10 is geometric (e.g., equal ratio of spacing between the driver units 10) or logarithmic. The number of driver units 10 included in the beamforming array 440 may be either an even number or an odd number. For example, as shown in FIG. 6A, the beamforming array 440 in FIG. 6A may comprise six (6) driver units 10, such as driver units $D_1$, $D_2$, . . . , and $D_6$.

$s_1$ is a spacing between driver units $D_1$ and $D_2$, $s_2$ is a spacing between driver units $D_2$ and $D_3$, $s_3$ is a spacing between driver units $D_4$ and $D_5$, and $s_4$ is a spacing between driver units $D_5$ and $D_6$. As shown in FIG. 6A, spacing $s_1$ between driver units $D_1$ and $D_2$ is equal to spacing $s_4$ between driver units $D_5$ and $D_6$, and spacing $s_2$ between driver units $D_2$ and $D_3$ is equal to spacing $s_3$ between driver units D4 and D5. The ratio of spacing $s_1$ to $s_2$ is the same as the ratio of spacing $s_4$ to $s_3$.

Figure 6B:
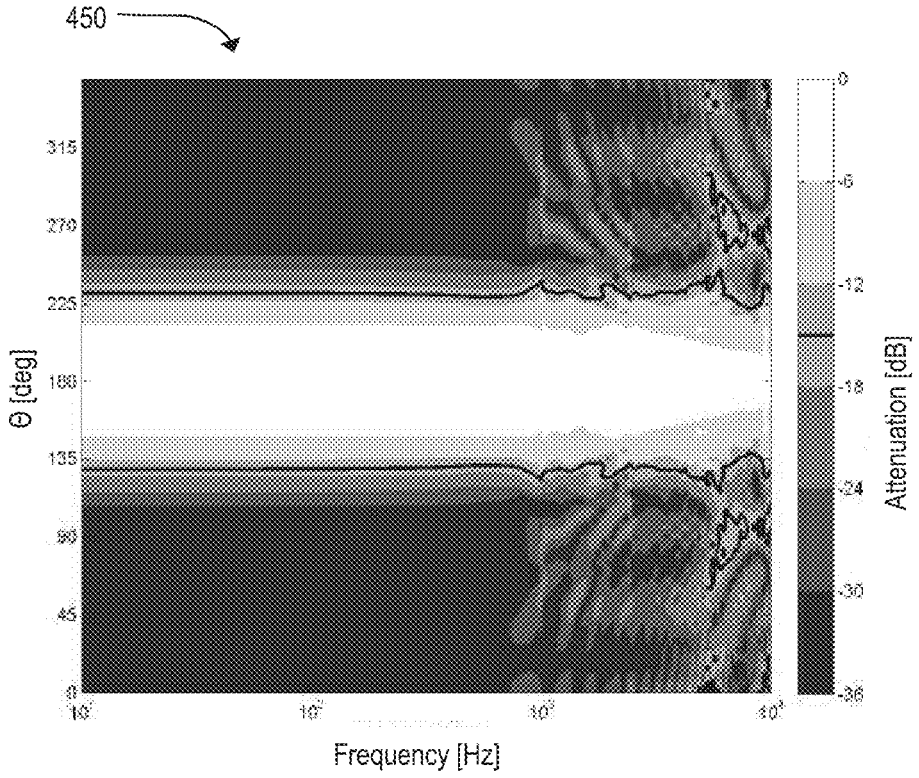
FIG. 6B is an example graph illustrating sound directivity curves in dB for the beamforming array in FIG. 6A, in accordance with one embodiment.

FIG. 6B is an example graph 450 illustrating sound directivity curves in dB for the beamforming array 440 in FIG. 6A, in accordance with one embodiment. Compared against graphs 510 (FIG. 4A) and 530 (FIG. 5B), graph 450 shows that the beamforming array 440 provides a broader sound frequency bandwidth with desired attenuation.

Figure 7A:
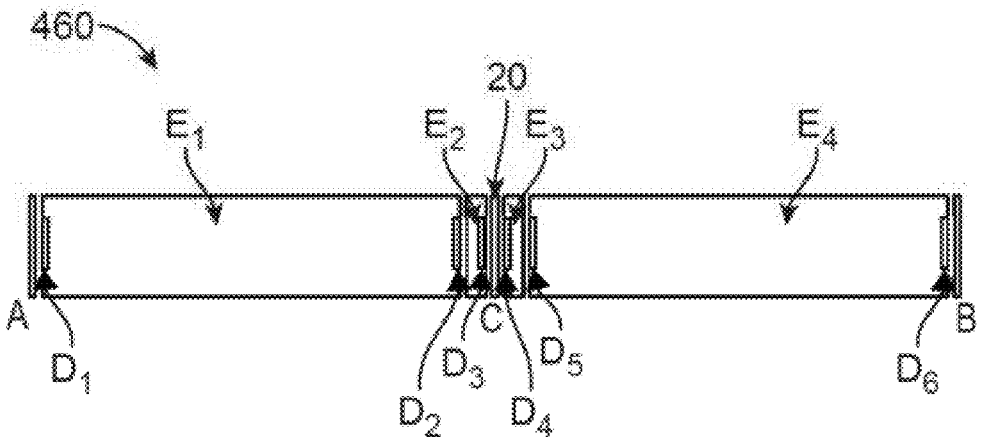
FIG. 7A illustrates another example beamforming array with a different end-fire configuration layout, in accordance with an embodiment.

FIG. 7A illustrates another example beamforming array 460 with a different end-fire configuration layout, in accordance with an embodiment. The beamforming array 460 comprises a plurality of driver units 10, wherein all but two driver units 10 are spaced as closely/tightly as possible around a center C of the beamforming array 460, and the remaining two driver units 10 are positioned within proximity of opposing end walls A and B of the beamforming array 460. The number of driver units 10 included in the beamforming array 460 may be either an even number or an odd number. For example, as shown in FIG. 7A, the beamforming array 460 may comprise six (6) driver units 10, such as driver units $D_1$, $D_2$, . . . , and $D_6$.

$s_1$ is a spacing between driver units $D_1$ and $D_2$, $s_2$ is a spacing between driver units $D_2$ and $D_3$, $s_3$ is a spacing between driver units $D_4$ and $D_5$, and $s_4$ is a spacing between driver units $D_5$ and $D_6$. As shown in FIG. 7A, driver units $D_2$, $D_3$, $D_4$ and $D_5$ are arranged as a tightly spaced cluster positioned as close as possible to the center C, and remaining driver units $D_1$ and $D_6$ are positioned within proximity of the end walls A and B, respectively. Spacing $s_1$ between driver units $D_1$ and $D_2$ is equal to spacing $s_4$ between driver units $D_5$ and $D_6$. Spacing $s_2$ between driver units $D_2$ and $D_3$ is equal to spacing $s_3$ between driver units $D_4$ and $D_5$. The extent to which driver units $D_2$, $D_3$, $D_4$ and $D_5$ may be spaced as closely/tightly together as possible is based on the smallest independent enclosure possible for the size of a driver unit 10.

Figure 7B:
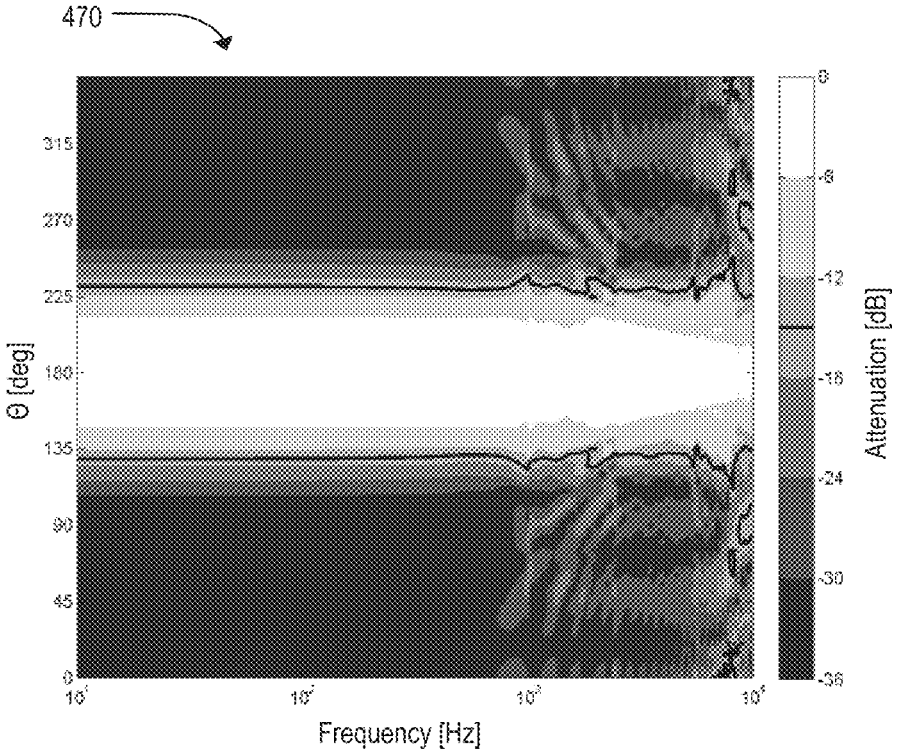
FIG. 7B is an example graph illustrating sound directivity curves in dB for the beamforming array in FIG. 7A, in accordance with one embodiment.

FIG. 7B is an example graph 470 illustrating sound directivity curves in dB for the beamforming array 460 in FIG. 7A, in accordance with one embodiment. Compared against graphs 410 (FIG. 4A), 430 (FIG. 5B), and 450 (FIG. 6B), graph 470 shows that the beamforming array 460 provides the broadest sound frequency bandwidth with desired attenuation.

Figure 8:
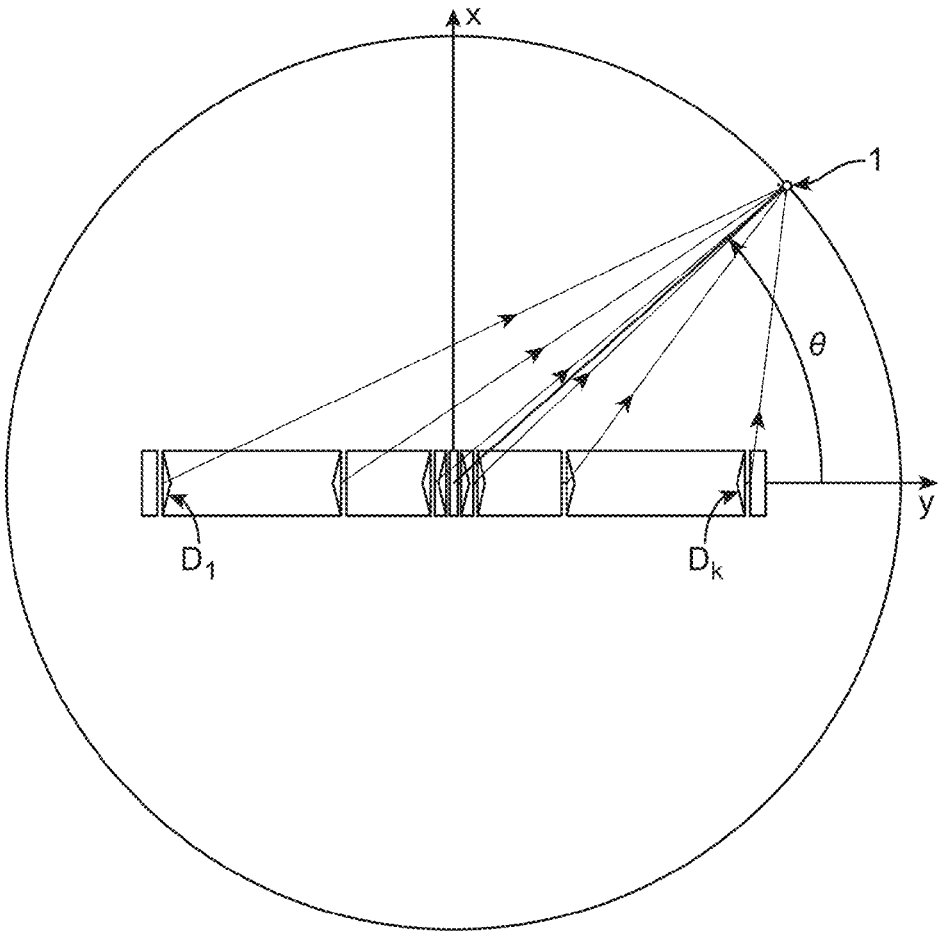
FIG. 8 illustrates a method for measuring angular responses of a driver unit in a beamforming array, in accordance with an embodiment.

FIG. 8 illustrates a method for measuring angular responses of a driver unit 10 in a beamforming array 100, in accordance with an embodiment. In one embodiment, for a beamforming array 100, sound directivity over the azimuth angle θ may be optimized utilizing digital filters. To obtain a specific and highly directive angular response over a large frequency bandwidth (e.g., 10 Hz to 10 kHz), a digital filter is defined for each driver unit 10 in the beamforming array 100.

Specifically, for each driver unit 10 in the beamforming array 100, angular responses of the driver unit 10 are measured over a given frequency grid (i.e., a set of frequency values) at regularly spaced angles on a circle 12 around the beamforming array 100. A reference source is a driver unit 10 in the beamforming array 100 that is used as a reference (e.g., a driver unit 10 closest to a center of the beamforming array). A target angular response is defined using an angular response of a reference source ("reference angular response"), wherein angular weighting is applied to the reference angular response along the regularly spaced angles, such that the target angular response is maximal in a specific direction over the frequency grid. At each frequency of the frequency grid, optimum gains are calculated for the angular responses of the driver units 10 as to reach the target angular response. Once complex gains for each frequency of the frequency grid are known, a time domain filter (e.g., a finite impulse response filter) for the driver unit 10 is defined.

In another embodiment, the target angular response need not be a function of an angular response of a reference source; instead, the target angular response may be any arbitrary complex response.

In one embodiment, a type of angular weighting applied is a positive windowing function. Examples of positive windowing functions may include, but are not limited to, Gaussian weighting, Hanning, Hamming, Blackman, BlackmanHarris, Chebychev, and Prolate Spheroidal (Slepian) sequences.

In one embodiment, each digital filter defined for each driver unit 10 is a finite impulse response (FIR) filter.

A Frequency Response Function (FRF) is a function representing complex gains in Pascals per Volt (Pa/V), r is a distance from an origin 1 to a driver unit 10 in the beamforming array 100, k is a source index in the range [1, K], ω is a frequency of the frequency grid, and $D_{\theta,k,\omega}$ is an angular FRF from a source at source index k (i.e., driver unit $D_k$ of the beamforming array 100) to a point (r, θ) on the circle 12 at frequency ω and angle θ.

Using a superposition principle, an overall angular FRF of the beamforming array 100 for a given angle θ and frequency ω is the sum of each angular FRF of each source (i.e., each driver unit 10 in the beamforming array 100). The overall angular FRF is computed in accordance with equation (1) provided below:

$$H_{\theta,\omega}=\Sigma_{k=1}^{K}D_{\theta,k,\omega} \quad (1).$$

A target angular FRF is defined using an angular FRF of a reference source, wherein angular weighting is applied to the angular FRF of the reference source along angle θ. The target angular FRF is computed in accordance with equation (2) provided below:

$$T_{\theta,\omega}=D_{\theta,k_0,\omega}W_{\theta} \quad (2),$$

wherein $k_0$ is the source index of the reference source, and $W_\theta$ is a type of angular weighting (i.e., real strictly positive) applied that is maximum for angle θ (e.g., Gaussian weighting).

For each frequency ω, a complex weight $G_{k,\omega}$ (i.e., a complex gain) to apply to an angular FRF of each driver unit 10 is estimated, such that a Euclidian distance from the weighted sum of the unit's FRF to the target angular FRF is minimized. The Euclidian distance is represented by equation (3) provided below:

$$\|T_{\theta,\omega}-\Sigma_{k=1}^{K}G_{k,\omega}D_{\theta,k,\omega}\|_2 \quad (3).$$

In one embodiment, a complex weight $G_{k,\omega}$ is estimated using standard linear least-squares techniques/solutions. For each driver unit $D_k$, a corresponding optimum gain vector $G_{k,:}$ along the frequencies defines a FRF from which a FIR filter may be derived by inverse Fast Fourier Transform (FFT). In another embodiment, other mathematical methods for estimating optimum gains at a given frequency ω may be used instead.

Table 1 below provides example pseudo-code for defining digital filters for each driver unit 10 in the beamforming array 100.

TABLE 1

Begin

TABLE 1-continued

```
Load angular FRF of all driver units into a three-dimensional (3D)
complex matrix D (a first dimension for frequency, a second dimension for
angles, and a third dimension for driver index);
Define angular weighting;
For each frequency
    Collect all FRF values for the frequency and for all angles and for all
    driver units into a matrix R;
    Define target angular FRF vector T along the angles using
    pre-defined weights from the angular weighting;
    Estimate an optimum gain vector G by solving the following system
    of linear equations using standard linear least-squares techniques: T =
    R G;
end;
Time domain filters are constructed by inverse FFT of complex gains,
yielding a FIR filter for each driver unit;
End.
```

For example, the matrix R referenced in Table 1 may be represented in accordance with equation (4) provided below:

$$R = \begin{pmatrix} D_{1,\theta_1,\omega} & \cdots & D_{K,\theta_1,\omega} \\ \vdots & \ddots & \vdots \\ D_{1,\theta_M,\omega} & \cdots & D_{K,\theta_M,\omega} \end{pmatrix}, \text{ for given } \omega. \quad (4)$$

For example, the vector T referenced in Table 1 may be represented in accordance with equation (5) provided below:

$$T=[T_{\theta_1}T_{\theta_2} \ldots T_{\theta_M}]^T \quad (5),$$

wherein superscript T is matrix transpose, and entries of matrix transpose T are represented by equation (2).

For example, the vector G referenced in Table 1 may be represented in accordance with equation (6) provided below:

$$G=[G_1,G_2, \ldots G_N]^T \quad (6).$$

The vector G referenced in Table 1 may be computed in accordance with equation (7) provided below:

$$G=[D^HD]^{-1}—D^HR \quad (7),$$

wherein superscript H is matrix conjugate transpose.

Figure 9:
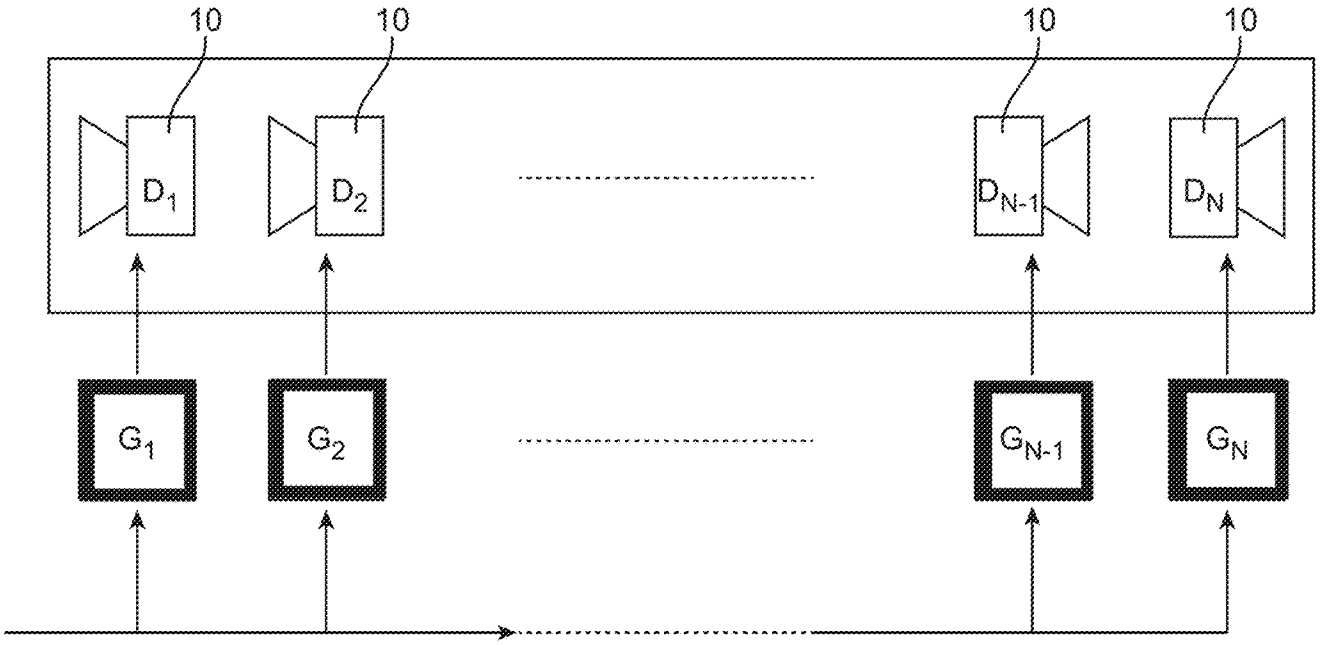
FIG. 9 illustrates example digital filters for a beamforming array, in accordance with one embodiment.

FIG. 9 illustrates example digital filters for a beamforming array 100, in accordance with one embodiment. Each driver unit 10 of the beamforming array has a corresponding digital filter. For example, a first driver unit $D_1$ has a corresponding digital filter $G_1$, a second driver unit $D_2$ has a corresponding digital filter $G_2$, . . . , an $(n-1)^{th}$ driver unit $D_{n-1}$ has a corresponding digital filter $G_{n-1}$, and an $n^{th}$ driver unit $D_n$ has a corresponding digital filter $G_n$. Each digital filter corresponding to each driver unit 10 provides individual digital signal processing (DSP) of signals received by each electrical signal pad of each amplification channel connected to the driver unit 10. The digital filters provide increased performance in off-axis attenuation (e.g., at least 10 dB more attenuation) and over an increased sound frequency bandwidth.

Figure 10:
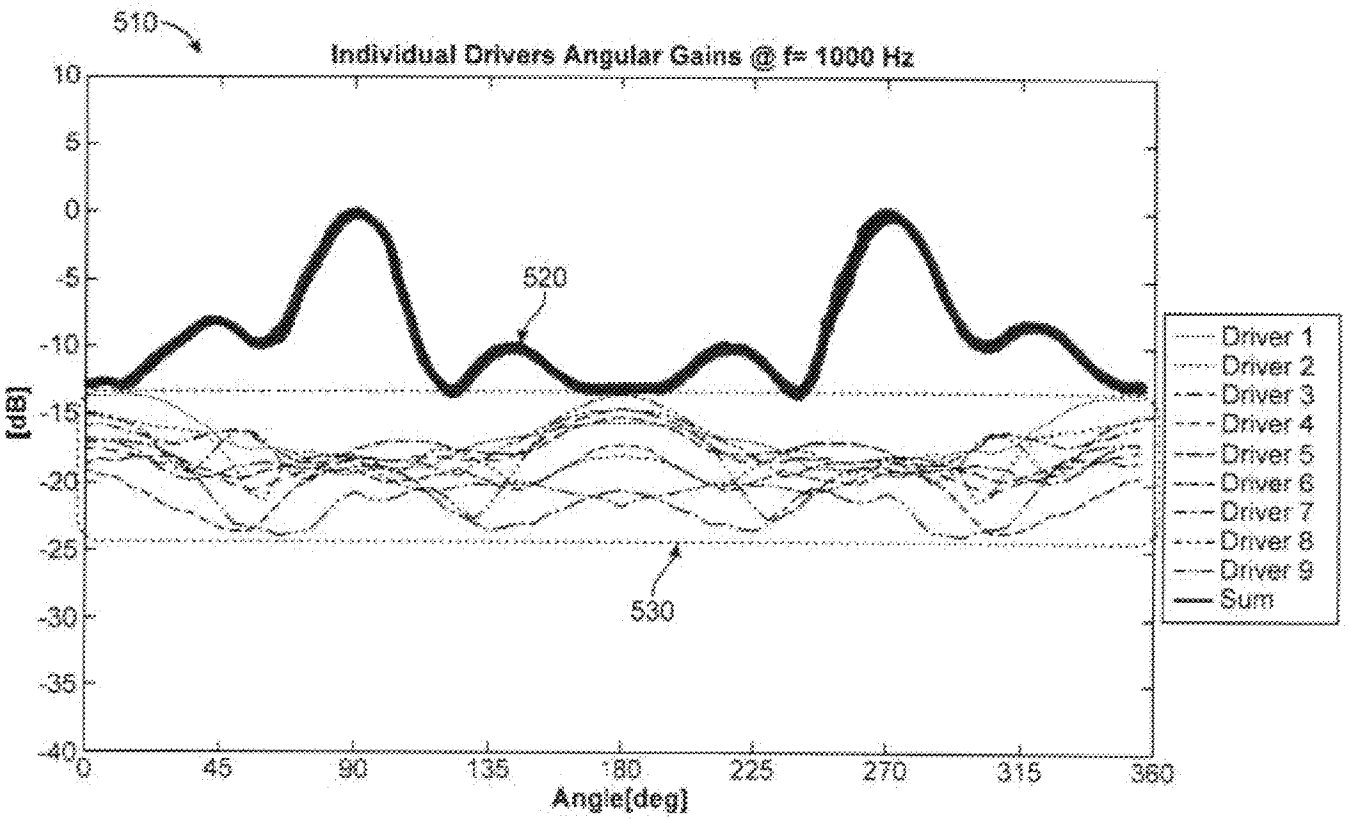
FIG. 10 is an example graph illustrating angular gains of individual driver units without digital signal processing (DSP)

FIG. 10 is an example graph 510 illustrating angular gains of individual driver units 10 without DSP. The graph 510 includes a set 530 of curves, wherein each curve represents an angular gain of an individual driver unit $D_i$ (e.g., $D_1$, $D_2$, . . . , $D_9$) in an array at a sound frequency of 1000 Hz. The graph 510 further includes a curve 520 representing a sum of each angular gain of each individual driver unit $D_i$. As shown in graph 510, the array beams sound with limited sound directivity, with a maximum at the perpendicular of the array (i.e., about 90 degrees and 270 degrees).

Figure 11:
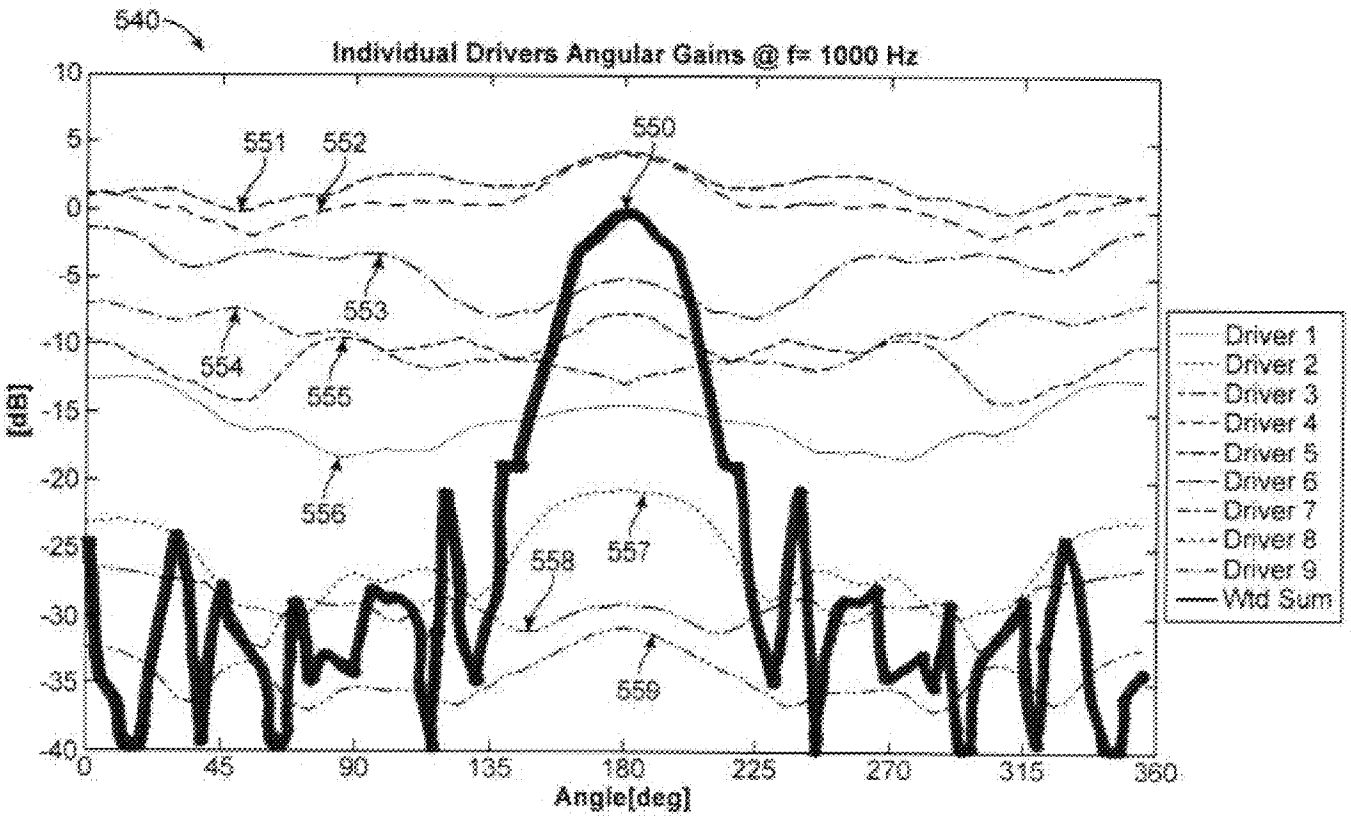
FIG. 11 is an example graph illustrating angular gains of individual driver units with DSP, in accordance with an embodiment.

FIG. 11 is an example graph 540 illustrating angular gains of individual driver units 10 with DSP, in accordance with an embodiment. Each curve 551, 552, . . . , 559 represents an angular gain of an individual driver unit $D_1$, $D_2$, . . . , $D_9$ with DSP, respectively, in a beamforming array at a sound frequency of 1000 Hz. The graph 540 further includes a curve 550 representing a weighted sum of each angular gain of each individual driver unit $D_1$, $D_2$, . . . , $D_9$. As shown in graph 540, the beamforming array produces a narrow dispersion of sound along a desired direction (e.g., 180 degrees).

Figure 12:
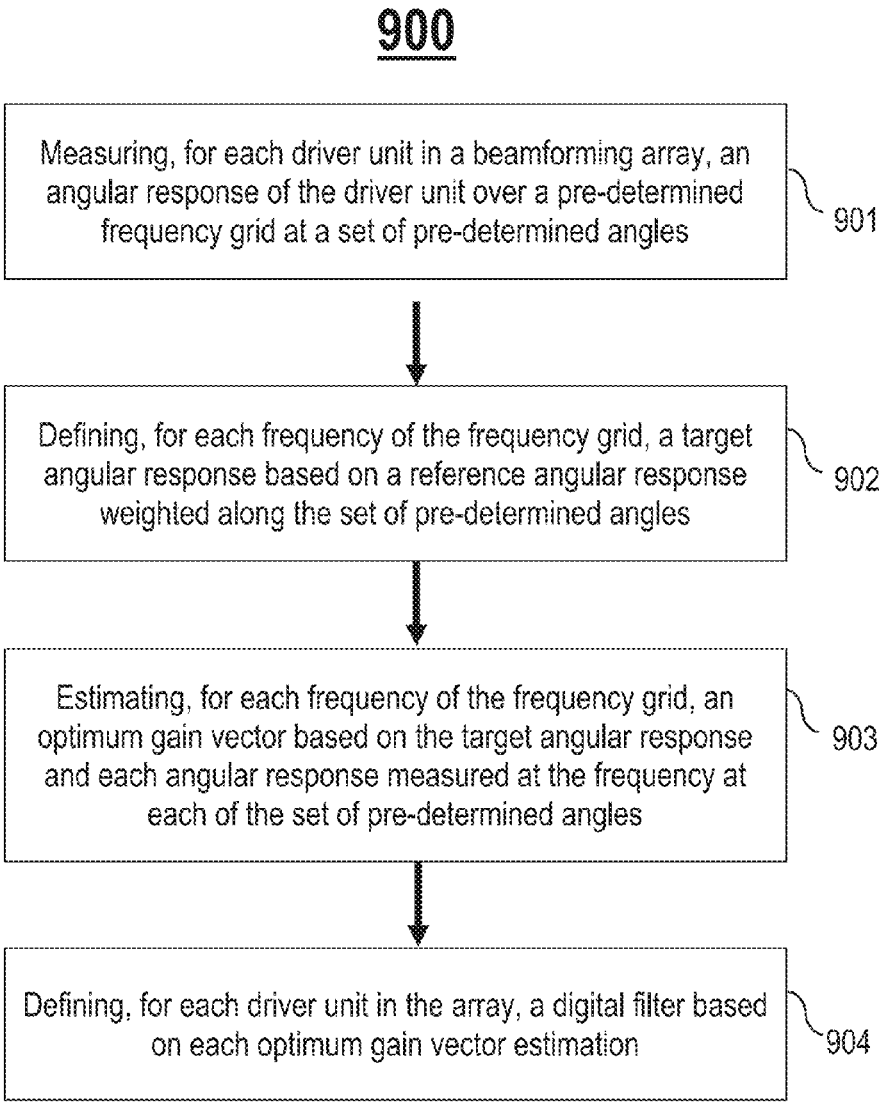
FIG. 12 is an example flowchart of a process for defining digital filters, in accordance with an embodiment.

FIG. 12 is an example flowchart of a process 900 for defining digital filters, in accordance with an embodiment. In process block 901, measuring, for each driver unit in a beamforming array, an angular response of the driver unit over a pre-determined frequency grid at a set of pre-determined angles. In process block 902, defining, for each frequency of the frequency grid, a target angular response based on a reference angular response weighted along the set of pre-determined angles. In process block 903, estimating, for each frequency of the frequency grid, an optimum gain vector based on the target angular response and each angular response measured at the frequency at each of the set of pre-determined angles. In process block 904, defining, for each driver unit in the array, a digital filter based on each optimum gain vector estimation.

Figure 13:
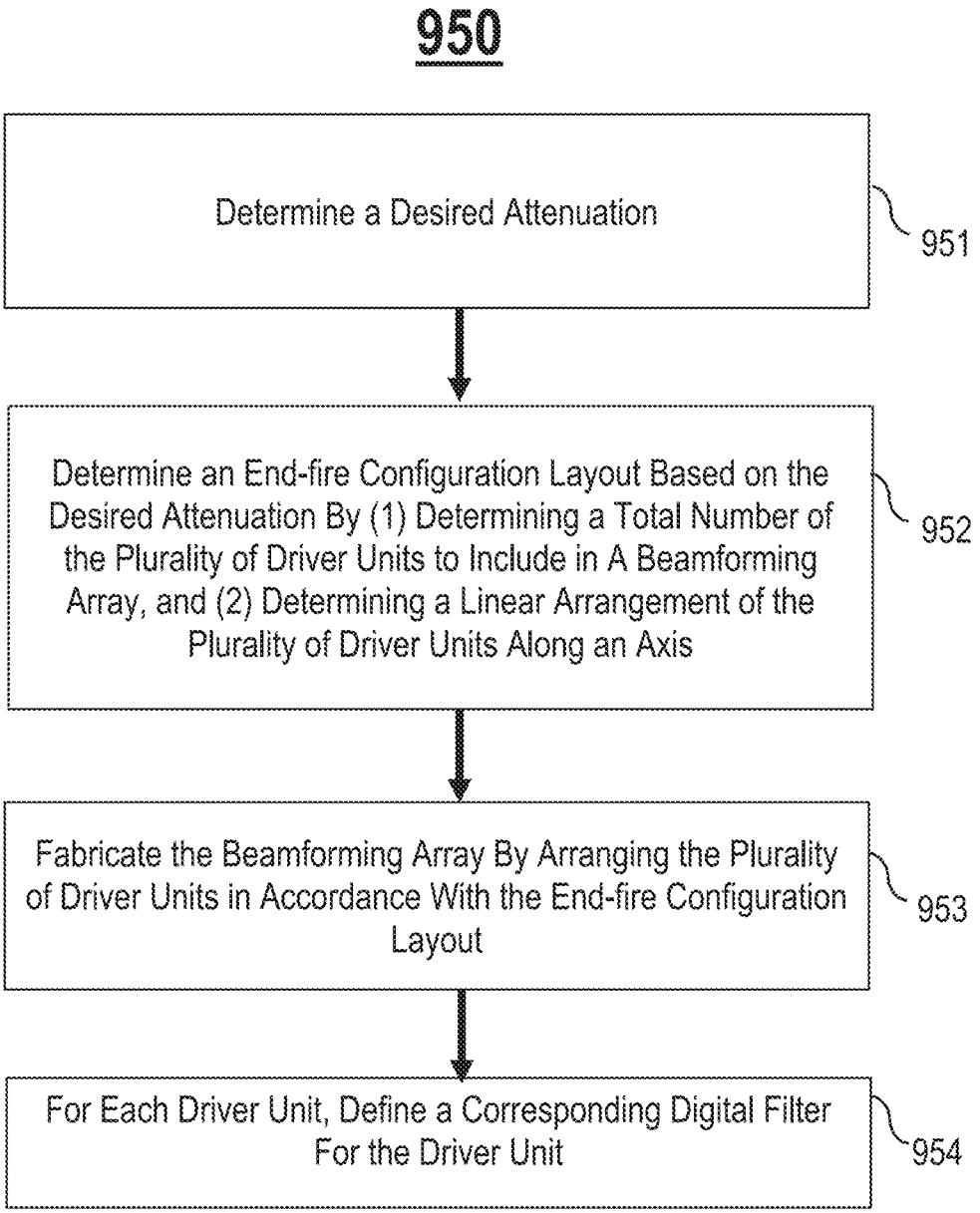
FIG. 13 is an example flowchart of a process for producing a beamforming array, in accordance with an embodiment.

FIG. 13 is an example flowchart of a process 950 for producing a beamforming array, in accordance with an embodiment. In process block 951, determine a desired attenuation. In process block 952, determine an end-fire configuration layout based on the desired attenuation by determining a total number of the plurality of driver units to include in a beamforming array and determining a linear arrangement of the plurality of driver units along an axis. In process block 953, fabricate the beamforming array by arranging the plurality of driver units in accordance with the end-fire configuration layout. In process block 954, for each driver, define a corresponding digital filter for the driver unit.

Figure 14:
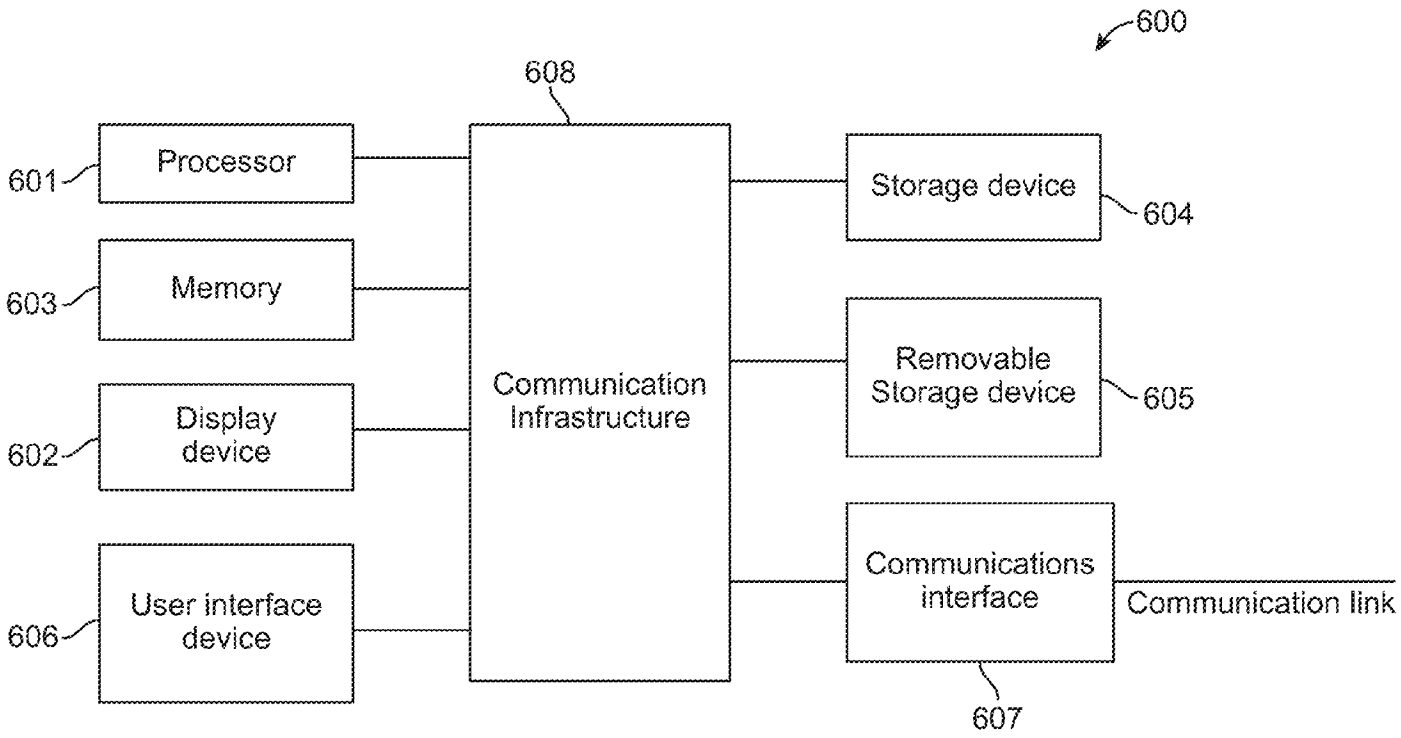
FIG. 14 is a high-level block diagram showing an information processing system comprising a computer system useful for implementing the disclosed embodiments.

FIG. 14 is a high-level block diagram showing an information processing system comprising a computer system 600 useful for implementing the disclosed embodiments. The computer system 600 includes one or more processors 601, and can further include an electronic display device 602 (for displaying video, graphics, text, and other data), a main memory 603 (e.g., random access memory (RAM)), storage device 604 (e.g., hard disk drive), removable storage device 605 (e.g., removable storage drive, removable memory module, a magnetic tape drive, optical disk drive, computer readable medium having stored therein computer software and/or data), user interface device 606 (e.g., keyboard, touch screen, keypad, pointing device), and a communication interface 607 (e.g., modem, a network interface (such as an Ethernet card), a communications port, or a PCMCIA slot and card). The main memory 603 may store instructions that when executed by the one or more processors 601 cause the one or more processors 601 to perform process blocks 901-904 of the process 900.

The communication interface 607 allows software and data to be transferred between the computer system and external devices. The system 600 further includes a communications infrastructure 608 (e.g., a communications bus, cross-over bar, or network) to which the aforementioned devices/modules 601 through 607 are connected.

Information transferred via communications interface 607 may be in the form of signals such as electronic, electromagnetic, optical, or other signals capable of being received by communications interface 607, via a communication link that carries signals and may be implemented using wire or cable, fiber optics, a phone line, a cellular phone link, an radio frequency (RF) link, and/or other communication channels. Computer program instructions representing the block diagram and/or flowcharts herein may be loaded onto a computer, programmable data processing apparatus, or processing devices to cause a series of operations performed thereon to produce a computer implemented process. In one embodiment, processing instructions for process 900 (FIG. 12) and process 950 (FIG. 13) may be stored as program instructions on the memory 603, storage device 604 and the removable storage device 605 for execution by the processor 601.

Embodiments have been described with reference to flowchart illustrations and/or block diagrams of methods, apparatus (systems) and computer program products. Each block of such illustrations/diagrams, or combinations thereof, can be implemented by computer program instructions. The computer program instructions when provided to a processor produce a machine, such that the instructions, which execute via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium", and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of one or more embodiments are described above with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A sound apparatus comprising:

a plurality of driver units arranged linearly in an end-fire beamforming array in accordance with a physical layout indicative of a physical orientation of each driver unit relative to another driver unit included in the beamforming array;

at least one container, wherein each container includes at least one driver unit of the plurality of driver units mounted on the container, the physical layout is further indicative of a total number of driver units mounted on each container, and the physical orientation of each driver unit is based on a total number of driver units mounted on the same container as the driver unit; and for each driver unit, a corresponding digital filter for individual digital signal processing of one or more signals received by the driver unit;

wherein the beamforming array together with each digital filter distributes sound with improved sound directivity over a sound frequency bandwidth based at least in part on the physical layout.

2. The sound apparatus of claim 1, wherein each driver unit comprises a ring radiator.

3. The sound apparatus of claim 1, wherein the physical layout is further indicative of a total number of the plurality of driver units.

4. The sound apparatus of claim 1, wherein each digital filter corresponding to each driver unit is defined based on, for each frequency of a pre-determined frequency grid, one or more complex gains to apply to one or more angular responses of the driver unit measured at the frequency at a set of pre-determined angles, and the one or more complex gains are estimated by minimizing a Euclidian distance from a weighted sum of the one or more angular responses to a target angular response for the frequency.

5. The sound apparatus of claim 1, wherein the beamforming array together with each digital filter distributes the sound along a desired direction with substantially constant sound directivity over the sound frequency bandwidth.

6. The sound apparatus of claim 1, wherein the physical layout is further indicative of spacing between the plurality of driver units, and the spacing between the plurality of driver units is one of equal spacing, geometric spacing, or logarithmic spacing.

7. The sound apparatus of claim 1, wherein the physical layout is further indicative of a position of each driver unit relative to a midpoint of the beamforming array, and the physical layout comprises:

a first driver unit of the plurality of driver units positioned at a first end of the end-fire beamforming array;

a second driver unit of the plurality of driver units positioned at a second end of the end-fire beamforming array; and remaining driver units of the plurality of driver units positioned clustered around the midpoint between the first end and the second end of the end-fire beamforming array.

8. The sound apparatus of claim 1, wherein each digital filter corresponding to each driver unit applies digital signal processing to each electrical signal pad of each amplification channel connected to the driver unit, providing increased performance in off-axis attenuation and increased sound frequency bandwidth.

9. The sound apparatus of claim 1, wherein a first driver unit and a second driver unit mounted on the same container are physically oriented to face different directions.

10. A method of beamforming sound for a plurality of driver units in a beamforming array, comprising:

measuring, for each driver unit in the beamforming array, an angular response of the driver unit over a pre-determined frequency grid at a set of pre-determined angles;

defining, for each frequency of the frequency grid, a target angular response based on a reference angular response weighted along the set of pre-determined angles;

estimating, for each frequency of the frequency grid, an optimum gain vector based on the target angular response and each angular response measured at the frequency at each of the set of pre-determined angles; and defining, for each driver unit in the beamforming array, a digital filter based on each optimum gain vector estimation;

wherein the plurality of driver units are arranged in the beamforming array in accordance with a physical layout indicative of a physical orientation of each driver unit relative to another driver unit included in the beamforming array, the beamforming array includes at least one container, each container includes at least one driver unit of the plurality of driver units mounted on the container, the physical layout is further indicative of a total number of driver units mounted on each container, the physical orientation of each driver unit is based on a total number of driver units mounted on the same container as the driver unit, and the beamforming array together with each digital filter distributes sound with improved sound directivity over a sound frequency bandwidth based at least in part on the physical layout.

11. The method of claim 10, wherein defining the target angular response based on the reference angular response weighted along the set of pre-determined angles comprises applying an angular weighting to the reference angular response.

12. The method of claim 11, wherein the angular weighting applied is based on a positive windowing function.

13. The method of claim 10, wherein defining the digital filter based on each optimum gain vector estimation comprises creating a finite impulse response (FIR) filter for each driver unit by applying an inverse Fast Fourier Transform (FFT) to each optimum gain vector estimation.

14. The method of claim 10, wherein the beamforming array is an end-fire beamforming array.

15. A method for producing a beamforming array, comprising:

determining a desired attenuation;

determining an end-fire configuration layout based on the desired attenuation; and fabricating the beamforming array by arranging a plurality of driver units in accordance with the end-fire configuration layout, wherein the end-fire configuration layout is indicative of a physical orientation of each driver unit relative to another driver unit included in the beamforming array, the beamforming array includes at least one-container, each container includes at least one driver unit of the plurality of driver units mounted on the container, the end-fire configuration layout is further indicative of a total number of driver units mounted on each container, the physical orientation of each driver unit is based on a total number of driver units mounted on the same-container as the driver unit, and the beamforming array distributes sound with improved sound directivity over a sound frequency bandwidth based at least in part on the end-fire configuration layout.

16. The method of claim 15, wherein determining an end-fire configuration layout based on the desired attenuation comprises:

determining a total number of the plurality of driver units to include in the beamforming array; and determining a linear arrangement of the plurality of driver units along an axis.

17. The method of claim 15, wherein arranging a plurality of driver units in accordance with the end-fire configuration layout comprises:

equally spacing apart the plurality of driver units.

18. The method of claim 15, wherein arranging a plurality of driver units in accordance with the end-fire configuration layout comprises:

geometrically or logarithmically spacing apart the plurality of driver units.

19. The method of claim 15, wherein arranging a plurality of driver units in accordance with the end-fire configuration layout comprises:

positioning a first driver unit of the plurality of driver units at a first end of the beamforming array;

positioning a second driver unit of the plurality of driver units at a second end of the end-fire beamforming array; and clustering remaining driver units of the plurality of driver units around a midpoint between the first end and the second end of the beamforming array.

20. The method of claim 15, further comprising:

for each driver unit, defining a corresponding digital filter for the driver unit, wherein the digital filter applies digital signal processing to each electrical signal pad of each amplification channel connected to the driver unit, and the beamforming array together with each digital filter distributes the sound along a desired direction with substantially constant sound directivity over the sound frequency bandwidth.

* * * * *